US005299715A

United States Patent [19]

Feldman

[11] Patent Number: 5,299,715

[45] Date of Patent: Apr. 5, 1994

[54] SYRUP DOSING VALVE FOR USE IN INSTALLATION FOR THE PREPARATION OF FLAVORED CARBONATED BEVERAGES

[76] Inventor: Joseph Feldman, 8 A.D. Gordon Street, Tel Aviv, Israel

[21] Appl. No.: 887,313

[22] Filed: May 22, 1992

[30] Foreign Application Priority Data

May 26, 1991 [IL] Israel ..... 98266

[51] Int. Cl.[5] ..... B67D 5/56

[52] U.S. Cl. ..... 222/129.1

[58] Field of Search ..... 222/61, 66, 129, 129.1, 222/129.4, 501, 52

[56] References Cited

U.S. PATENT DOCUMENTS 3,948,419 4/1976 Polster ..... 222/129.1

5,082,143 1/1992 Schramm, Jr. ..... 222/66

*Primary Examiner*—Jesus D. Sotelo

*Attorney, Agent, or Firm*—Ostrolenk, Faber, Gerb & Soffen

[57] ABSTRACT

A syrup dosing valve for use in soft drink dispensing installations is disclosed in which the quantity of syrup supplied is adjustable by means of a screw threaded adjusting pin. The adjusting pin is associated with pressure sensing means, in communication with and responsive to the syrup inlet pressure, in order to enable the valve to be disabled, thereby prevent further use of the installation once a pressure of the syrup supply is sensed. In one embodiment, the pressure sensing means comprise a diaphragm operated electric switch, mounted on head portion of the adjusting pin. Flow damping means may be provided for stabilizing the operation of the switch.

10 Claims, 5 Drawing Sheets

SYRUP DOSING VALVE FOR USE IN INSTALLATION FOR THE PREPARATION OF FLAVORED CARBONATED BEVERAGES

FIELD OF INVENTION

The present invention relates to installations for the dispensing of carbonated beverages prepared by adding flavoured syrup in a suitable proportion to carbonated or soda water, consisting of an admixture of plain water and $CO_2$ gas, as found in restaurants, bars, hotels and the like.

BACKGROUND OF THE INVENTION

Such installations typically include a water source, a vessel of pressurized CO apparatus for mixing the $CO_2$ with the water for making carbonated water, and exchangeable containers or vessels for the flavoured syrup supplied by the syrup manufacturer.

For the purpose of better understanding the object of the present invention, reference shall be made to FIG. 1, schematically illustrating a typical layout of installations of the kind referred to above.

Hence, the installation comprises a water source 10, a pressurized vessel containing carbon dioxide gas 12 and apparatus 14 for admixing and dissolving the $CO_2$ gas 12 in the water from source 10. The installation further includes the necessary devices for mixing the carbonated water with the soft drink syrup contained in a syrup container 16. As schematically shown, the dispensing machine head generally denoted 20 is normally activated when filler arm 22 is moved as by cup 24. A solenoid 26 opens a shut-off valve 28 and simultaneously actuates a carbonated water pump 30 and syrup pump 32 thereby controlling the flow of carbonated water and syrup respectively, in pre-determined proportions. Normally the proportion between carbonated water and syrup is 5:1. The mixture regulated by water valve 34 and syrup valve 36 is then dispensed via dispenser 38 to spout 39. These installations, with minor changes, are widely used all over the world.

It has recently been desired, by the beverage producing companies leasing such installations, to incorporate means for completely disabling the installation once the supply of syrup is interrupted, for example, when the syrup reservoir 16 has been exhausted. Since the installation was leased for the supply of a beverage based on the syrup produced by such leasing company, it should not be used for dispensing carbonated water which could be then consumed on its own or to which syrup may be added externally. The installation should thus be operable only when the syrup reservoir has been refilled or replaced with the leasing company's syrup.

Several solutions have been proposed to solve the problem. One solution incorporates a level indicating device 40, placed in the syrup reservoir 16, operatively connected as symbolized by line 42, which operates solenoid 26 so as to disable the operation of the shut-off valve 28, namely, keeping it closed once the level of syrup has reached the bottom of the reservoir 16.

According to another proposition, a pressure sensitive element 44 is operatively connected from the syrup supply line 46 to the mixing head of the machine, downstream of the pump 32. The device 44 similarly disables operation of the shut-off valve 28 through solenoid 26 once pressure in the line 46 drops as a result of the syrup reservoir becoming empty.

These two proposals suffer from the same disadvantage, namely that changes must be applied to the installation, remotely and outside the machine head 20. In the first example an electric cable must be connected (42) to the head of the dispensing machine 20 on the one hand and to the syrup reservoir 16 on the other hand, the reservoir being remotely located therefrom. According to the second proposition the syrup pipeline must be interrupted so that the device 44 could be included therein.

It is thus the major object of the invention to provide means for controlling operation of the carbonated soft drinks dispenser, with minimum interference to the construction of the installation as a whole.

It is a further object of the invention that the component part of the installation included in the dispenser head can be easily replaced by a modified component achieving the desired result.

It is a still further object of the invention to modify the construction of the syrup dosing adjusting element, associated with the syrup control valve, which element would be the replacable component capable of achieving the goal of the present invention.

SUMMARY OF THE INVENTION

According to the invention there is provided an improvement to installations for the dispensing of carbonated flavoured beverages by the admixture of flavoured liquid syrup with carbonated water, the installation comprising a water source, a pressurized $CO_2$ supply source, a syrup supply source, a control valve for regulating the flow of carbonated water, a control valve for regulating flow of the syrup, a mixing head wherein the carbonated water and the syrup become admixed and dispensed through a dispensing spout and an electrically controlled shut-off valve normally closing the dispensing spout, the syrup flow control valve comprising a housing with an inlet and outlet for the syrup, a fixed cylinder with a series of peripheral openings in communication with the outlet, a floating cup-shaped plunger within the cylinder, for partly closing the openings, as a function of the syrup pressure applied to the bottom of the plunger through the inlet, an orifice at the bottom of the plunger, through which the syrup is admitted into the plunger to be discharged through the cylinder peripheral openings and a counterforce compression spring acting against the plunger by a screw-threaded adjusting pin having a head portion accessible for rotating the pin and thereby adjusting the quantity of syrup supplied to the mixing head, the improvement of providing pressure sensing means mounted on the head portion, in communication with and responsive to the syrup inlet pressure prevailing inside the plunger, operatively coupled to means for disabling the shut-off valve, thereby preventing use of the installation upon a pressure drop sensed by the pressure sensing means.

According to one preferred embodiment of the invention the pressure sensing means comprise a diaphragm operated electric switch, one side of the diaphragm communicating with the interior of the plunger via a throughgoing bore formed in the adjusting pin.

BRIEF DESCRIPTION OF THE DRAWINGS

Further details and advantages of the invention will become more clearly understood in the light of the ensuing description of a preferred embodiment of the invention, given by way of example only with reference to the accompanying drawings, wherein—

DETAILED DESCRIPTION OF THE PREFERRED EMBODIMENTS

Figure 2:
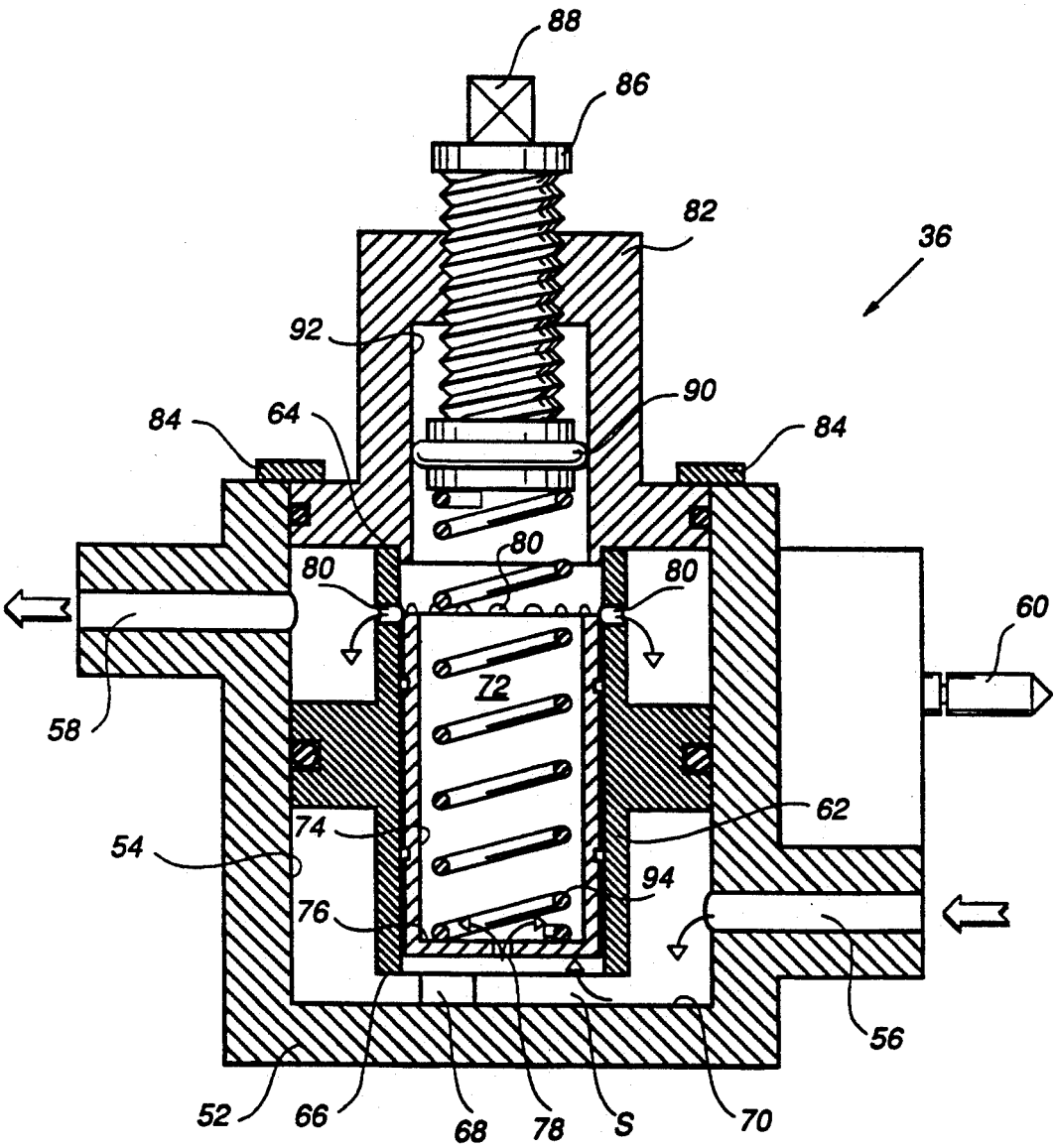
FIG. 2 (PRIOR ART)
FIG. 2 is a cross-sectional view of the syrup control valve of conventional design.

In FIG. 2 there are shown only the parts of the syrup supply control valve, which are relevant for the purposes of describing the features of the present invention. It should be borne in mind that the carbonated water supply control valve 34 and the syrup supply control valve 32 are essentially of an identical construction, the two valves being located in a common housing made of injected plastic construction, combined with the solenoid operated shut-off valve mixer 28 and supplied as such by the manufacturer of such installations (for example, the Cornelius Company of Anoka Minn. USA).

The invention is therefore described with application to this model, being the most popular and widespread. In more detail, the syrup control valve 36 comprises a housing 52 which defines an inner cylindrical wall 54, a syrup inlet 56 and outlet 58. The housing as a whole (including that of the carbonated water valve (not shown)) is separable and mountable to a chest plate of the dispenser head by a plug 60 in the conventional manner. Within the cylindrical wall 54, there is seated and sealed thereagainst, a fixed cylinder 62 (which is manufactured from ceramic material so as to achieve the precision required), opened at its top and bottom sides 64 and 66 by being seated on one or more projections 68 at a distance 'S' from bottom wall 70 of the housing.

Thus, syrup entering the inlet 56 can reach the interior of the cylinder 62. Within that cylinder, a cup shaped plunger 72 (also manufactured from ceramic material) is freely seated, having a circular wall 74 and a bottom wall 76 with an orifice 78. The cylinder 62 further comprises a series of peripheral openings 80, deployed around the circumference at a distance somewhat higher than the height of the plunger 72, the arrangement being such that when the plunger is displaced upwards, it is adapted to close the series of openings 80 and therefore regulate up to complete cut-off the supply of syrup to the outlet 58.

A cover 82 is seated hermetically closing the inner cylinder 54 of the housing 52 and held by dismantable clamp 84. The cover 82 has a female screw thread adapted to receive an adjusting pin 86 with square head 88. The adjusting pin 86 is provided with seal ring 90 and is therefore sealed against leakage of the syrup from within the cylinder 54, but is displaceable along inner cylindrical wall 92 of the cover member 82.

A compression coil spring 94 is placed between the inner end of the pin 86 and the bottom wall 76 of the plunger 72.

It will be thus readily understood that the dosing or control of the amount of syrup allowed to be passed through the valve 36 is adjusted by rotating the pin 86 thereby applying a smaller or greater strain force against the plunger 72. On the other hand, the plunger is pushed upwards by the inlet pressure of the syrup entering the inlet 56 and through the orifice 78 into the interior of the plunger 72. Thus, the plunger 72 attains a state of equilibrium, the location of the plunger determining the extent to which the openings 80 are closed or opened. It should be noted that, once the main shut-off valve 28 (FIG. 1) is opened, the pressure prevailing in the outlet 58 and above the plunger 72 is close to—but still above—atmospheric pressure.

As already mentioned cylinder 62 and plunger 72 are made of ceramic material because of the high degree of precision required.

Figure 3:
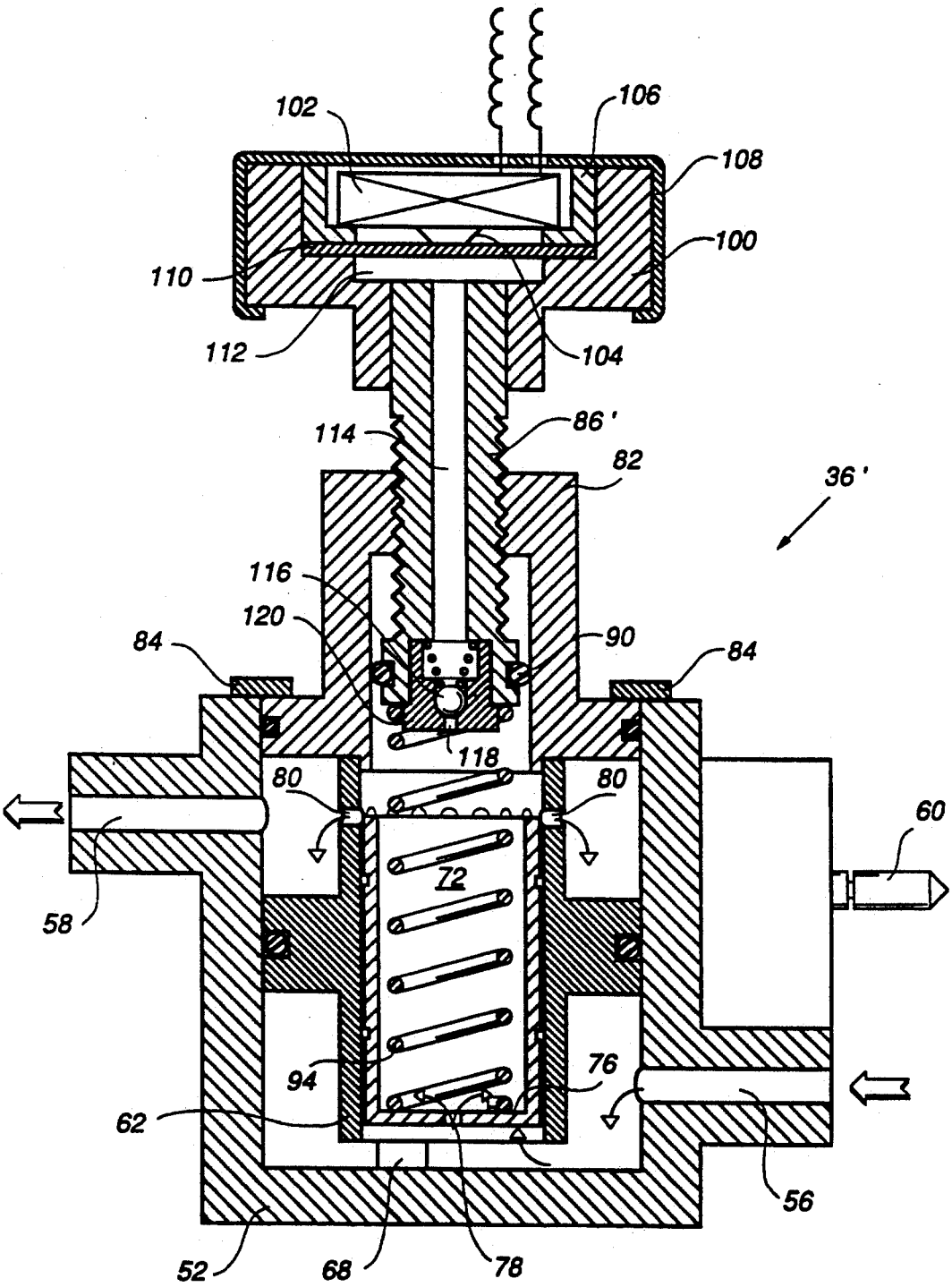
FIG. 3 is a cross-sectional view of syrup control valve including the improvement according to the present invention.

Turning now to FIG. 3 there is shown the syrup control valve including the improvement proposed according to the invention.

As aforementioned one object of the invention is to control operation of the carbonated soft drinks dispenser so that the dispenser will cease to function in the event of an interruption in the syrup supply; a further object being to achieve this aim by introducing minimum changes to the construction of the system as a whole, and in particular to the construction of the control valve. Thus it is proposed that the adjusting pin marked 86 in FIG. 2 and 86' in FIG. 3 be altered thus enabling the existing installation to be modified simply by replacing the adjusting pin 86.

As shown in FIG. 3, the square head 88 (FIG. 2) of the conventional adjusting pin 86 is altered and becomes a base for carrying a head member 100 forming a housing for microswitch 102 having an operating button 104. The microswitch is seated within a circular shell 106 and preferably covered by a metal covering 108 although any other suitable encasement can be used.

Below the operator 104 of the microswitch 102 a diaphragm 110 is clamped at its periphery as shown, defining an air pressure chamber 112 thereunder. The pin 86' has a through-going bore 114 with a pulse damping assembly of any conventional type provided at its lower end. A damping assembly is needed in order to avoid "hunting" or otherwise unstable operation of the microswitch 102; this is particularly important in cases where the syrup pump 32 (FIG. 1) is of the "pulsating" type, where the inlet pressure alternates between its higher level and zero level in pulses, and, of course, at the beginning and termination of the pump operation.

In the embodiment shown in FIG. 3, the damping assembly consists of a ball valve member 116, spring urged against restricted valve opening 118, incorporated in a screw-threaded insert 120. Either the ball 116 or the valve seat is provided with a tiny passage (not shown) through which the syrup is allowed to leak downwards even in the "closed" state of the valve, thus acting as a damper, rather than a check-valve.

It will be readily understood that in this manner, the inlet pressure prevailing within the cylinder 72 is relayed to the chamber 112 via the valve seat opening 118 and the bore 114, the arrangement being such that once a pressure of predetermined amount is available the diaphragm 110 will operate the microswitch 102 and if the inlet pressure drops below a predetermined level the diaphragm will relieve the operator 104 and the microswitch will resume its normal (non-activated) position.

Figure 1:
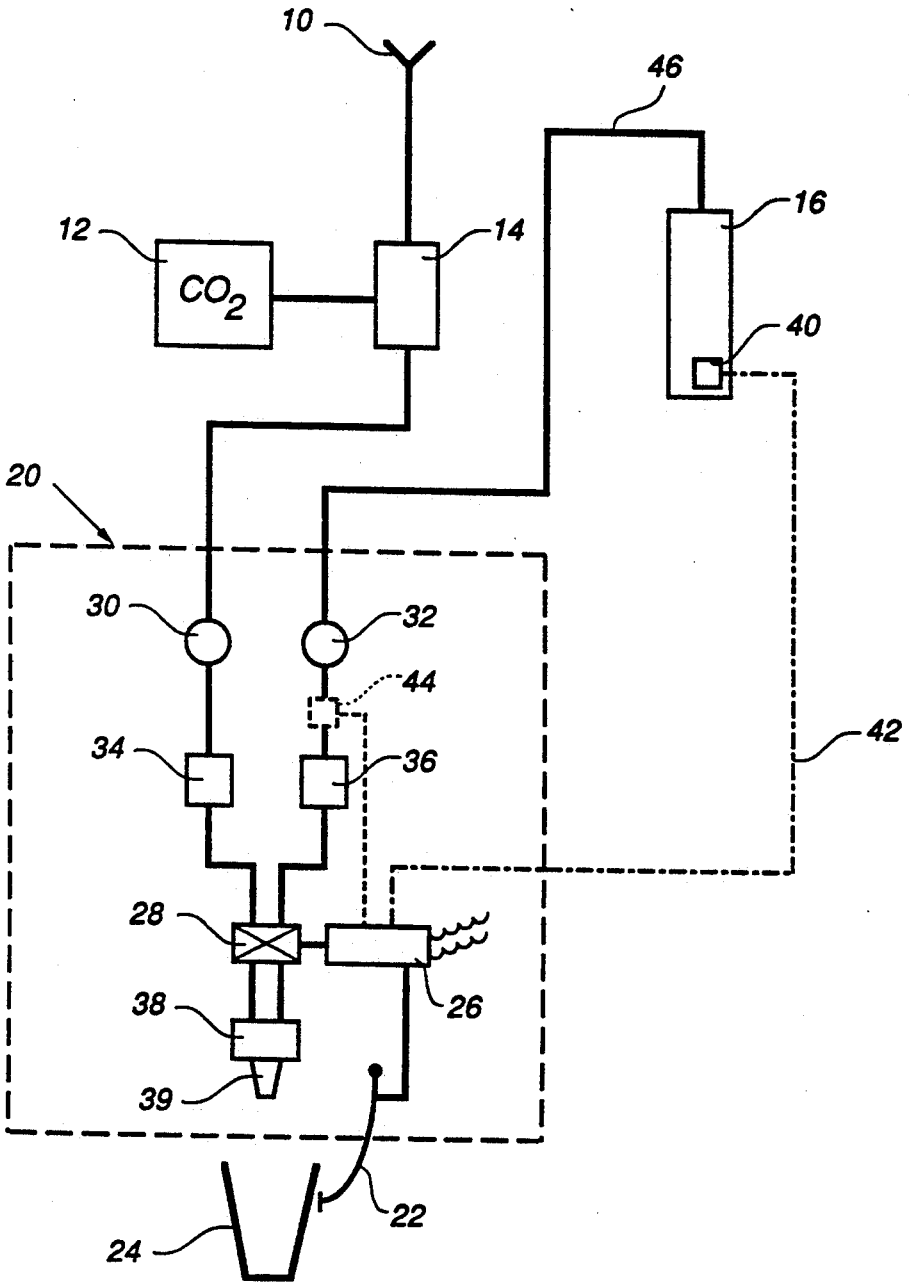
FIG. 1 is a schematic layout of a dispensing installation.

The operation of the modified syrup control valve (shown in FIG. 3) will now be briefly described:

The microswitch 102, which is of the normally open type is connected in series with the solenoid 26 (FIG. 1). As long as syrup is being supplied at the required pressure into the inlet 56, the solenoid 26 operates the valve 28 in the normal manner. Upon relief of the operator 104, due to a pressure drop occurring when the syrup reservoir 16 is exhausted, the microswitch 102 will deactivate the solenoid 26, closing the valve 28, irrespective of and overriding the commands received by the operation of the filler lever 22. The shut-off valve 28 will remain closed and carbonated water alone will not be able to be supplied.

Figure 4:
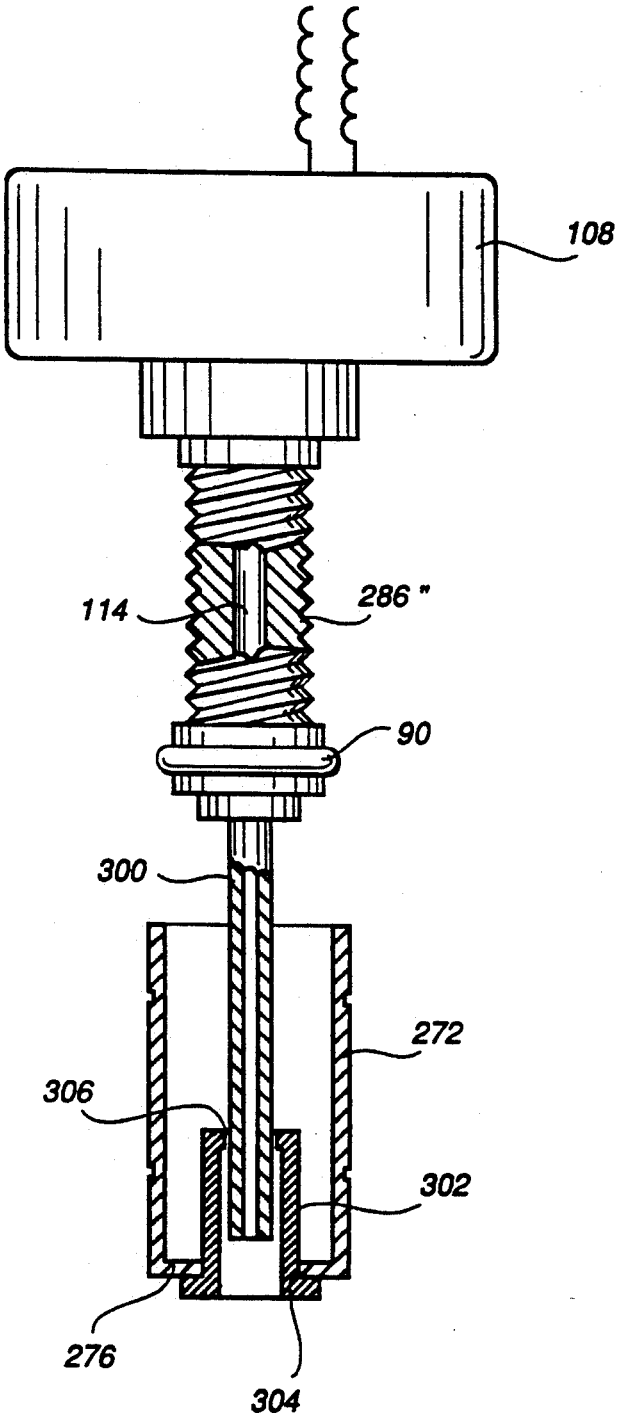
FIG. 4 is a modification of the valve in FIG. 3 (the remaining parts and components of the system being omitted)

In the modified embodiment illustrated in FIG. 4 (only the changed parts being shown), a tube 300 is inserted into the bore 114 of the adjusting pin 286'' (86' in FIG. 3), communicating with the bore and extending same down to a level next to the bottom of cylinder 272. At the bottom 276 of the plunger 272 there is inserted an inverted cup-shaped insert 302 which is press fitted within an opening 304 at the center of the bottom 276 (which is in fact an enlargement of the orifice 78 in FIG. 3). The insert 302 has an opening 306 with an annular cross-sectional area 302, namely around the tube 300 equal to the original cross sectional area of the orifice 78 in order not to upset the proportional or dosing feature of the device as a whole.

The tube 300 is preferably made of a non-rigid material so that replacement of the conventional pin 86, by the modified pin 286'', can be achieved smoothly. In the case of the embodiment shown in FIG. 4, the inlet pressure prevailing below the cylinder 272 is relayed to the microswitch 102 (FIG. 3) via the tube 300 and the bore 114, that is, upstream of the orifice 78, which may add to the reliability of the microswitch control operation.

Figure 5:
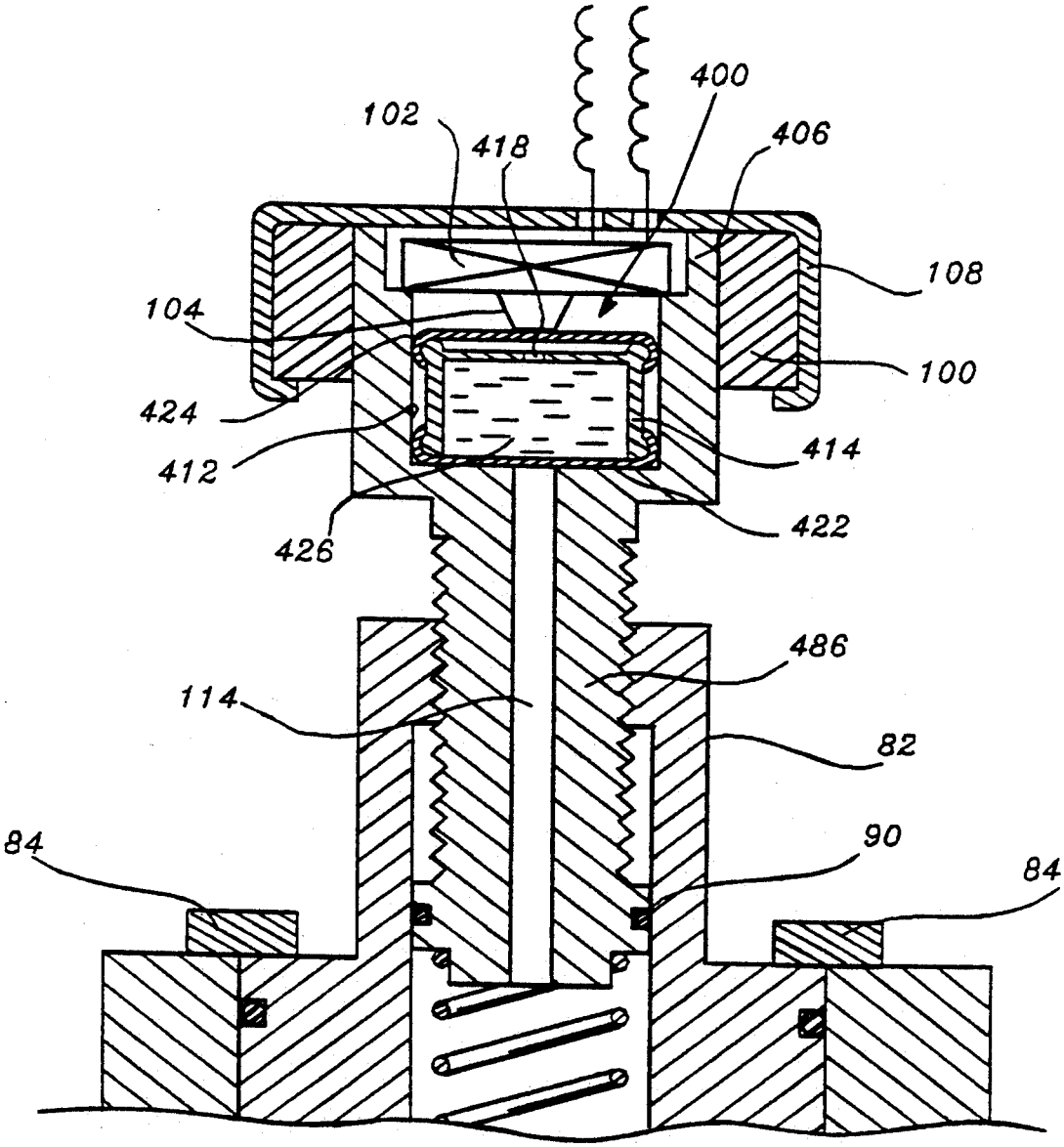
FIG. 5 is a further modification of the valve of FIG. 3.

FIG. 5 illustrates a further modified embodiment to the valve shown in FIG. 3 (only the relevant changed parts being shown). A damping assembly generally denoted 400 is installed, adjacent to the operating button 104 of the microswitch 102 at the top of the through-going bore 114 (in contrast to FIG. 3 where the damping assembly is installed at the lower end of the through-going bore). The design of the spindle 486' is somewhat changed, to form a compartment 412.

An inverted, cup-like container 414 is provided, being open at its lower end and having an orifice 418 formed within it's closed upper end 420. Both the lower and the upper ends are enclosed with tight fitting diaphragm 422 and 424, respectively.

The container 414 is filled with a hydraulic fluid 426, preferably an edible oil such as olive oil which is light, natural and, in the event of any unforeseen occurrence, will not pollute the drink should it get mixed therewith and served.

In the case of the embodiment of FIG. 5, the damping is effected by the presence of the fluid 426. The inlet pressure admitted via the valve bore 114 causes the diaphragm 422 to be distorted convexly, pressing the fluid 426 upwards and via the orifice 418 distorting convexly the upper diaphragm 424 and thus pushing the button of the microswitch 102.

The damping assembly 400 illustrated in the embodiment of FIG. 5 requires less parts than that shown in FIG. 3 and by being in direct contact with the microswitch 102 allows for a more stable operation.

It has thus been established that by a most simple operation, namely the exchange of one of the conventional components of the system (the dosing adjusting pin) by a modified component—any existing installation can be improved by gaining control over the dispensing of soft drink syrup, for the benefit of both the syrup producing and leasing companies and the customer.

Those skilled in the art will readily appreciate that various changes, modifications and variations may be applied to the invention as heretofore exemplified, without departing from its scope as defined in and by the appended claims.

What is claimed is:

1. A syrup flow control valve for regulating the flow of syrup in a carbonated soft drink dispensing installation which includes a water and $CO_2$ supply source, a syrup supply source, a control valve for regulating the flow of carbonated water, a mixing head, wherein the carbonated water and the syrup become admixed and dispensed through a dispensing spout, and an electrically controlled shut-off valve normally closing the dispensing spout, the syrup flow control valve comprising:

a housing having an inlet and outlet for the syrup;

a fixed cylinder having a plurality of peripheral openings in communication with the outlet;

a floating cup-shaped plunger, having a bottom, disposed within the cylinder, for partly closing said openings as a function of the syrup pressure applied to the bottom of the plunger through said inlet, and an orifice in the bottom of the plunger, through which the syrup is admitted into the plunger to be discharged through said peripheral openings of the cylinder;

a counter-force compression spring disposed within the plunger, said spring being biased against the plunger by a screw-threaded adjusting pin, said adjusting pin having a head portion accessible for rotating the pin and thereby adjusting the quantity of syrup supplied to the mixing head; and pressure sensing means disposed within said head portion of said adjusting pin in communication with and responsive to the syrup inlet pressure prevailing within the plunger, operatively coupled to means for disabling the shut-off valve for preventing use of the installation when a pressure drop is sensed by said pressure sensing means.

2. The syrup flow control valve as claimed in claim 1, wherein the pressure sensing means comprise a diaphragm operated electric switch, one side of the diaphragm communicating with the interior of the plunger via a bore extending through the adjusting pin.

3. The syrup flow control valve as claimed in claim 2, further comprising flow damping means provided in the bore upstream of the diaphragm, for preventing unstable operation of the electric switch.

4. The syrup flow control valve as claimed in claim 3, wherein the flow damping means comprise a compression spring acting against a ball valve seated within a restricted valve seat orifice incorporated within a screw threaded insert, said screw threaded insert being attached to the lower end of said bore.

5. The syrup flow control valve as claimed in claim 3, wherein the flow damping means comprise a container open at its lower end and having an aperture formed within its upper end, both the lower end and the upper end being enclosed with tight fitting diaphragms and the container being filled with a hydraulic fluid.

6. The syrup flow control valve as claimed in claim 5 wherein the hydraulic fluid is an edible oil.

7. The syrup flow control valve as claimed in claim 2, wherein the bore is extended by a tube passing through said orifice at the bottom of the plunger.

8. The syrup flow control valve as claimed in claim 7, wherein the plunger bottom comprises a raised, inverted cup-shaped member, an opening formed in the bottom of the member for receiving said tube, said opening having a diameter that leaves around the tube an annular restricted opening which comprises said orifice.

9. The syrup flow control valve as claimed in claim 8, wherein said tube is a non-rigid material.

10. A syrup flow control valve for use in a carbonated soft drink dispensing installation which includes a water and $CO_2$ supply source, a syrup supply source, a control valve for regulating the flow of carbonated water, a mixing head wherein the carbonated water and syrup becomes mixed and dispensed through a dispensing spout, and an electrically controlled shut-off valve normally closing the dispensing spout, the syrup flow control valve comprising:

a housing having an inlet and outlet for the syrup;

a fixed cylinder having a plurality of peripheral openings in communication with the outlet;

a floating, cup-shaped plunger, having a bottom, disposed within the cylinder for partly closing said openings as a function of the syrup pressure applied to the bottom of the plunger through said inlet, and an orifice at the bottom of the plunger, through which the syrup is admitted into the plunger to be discharged through said peripheral openings of the cylinder;

a counter-force compression spring disposed within the plunger, said spring being pressed against the plunger by a screw-threaded adjusting pin, said adjusting pin having a head portion accessible for rotating the pin and thereby adjusting the quantity of syrup supplied to the mixing head; and pressure sensing means disposed within said head portion of said adjusting pin in communication with and responsive to the syrup inlet pressure prevailing within said plunger, said pressure sensing means comprising an electric switch operated by a diaphragm, one side of the diaphragm communicating with the interior of the plunger via a bore extending through the adjusting pin, said pressure sensing means being operatively coupled to means for disabling the shut off valve for preventing use of the installation when a pressure drop is sensed by said pressure sensing means.

* * * * *